United States Patent [19]

Ohashi et al.

[11] 4,217,871

[45] Aug. 19, 1980

[54] FUEL INJECTION DEVICE FOR COMPRESSION IGNITION ENGINE

[75] Inventors: Kanji Ohashi, Tokyo; Kazuo Kontani, Higashi-Kurume; Yoshitada Uchiyama, Abiko; Kinichi Motohashi, Tokyo, all of Japan

[73] Assignees: Agency of Industrial Science & Technology; Ministry of International Trade & Industry, both of Tokyo, Japan

[21] Appl. No.: 937,418

[22] Filed: Aug. 28, 1978

[30] Foreign Application Priority Data

Aug. 30, 1977 [JP] Japan ..... 52-103803

[51] Int. Cl.[2] ..... F02M 39/00

[52] U.S. Cl. ..... 123/501; 123/299

[58] Field of Search ..... 123/139 AP, 32 F, 32 G, 123/139 AN

[56] References Cited

U.S. PATENT DOCUMENTS

| | | | |
|---|---|---|---|
| 1,830,839 | 11/1931 | Kasley | 123/139 AP |
| 2,001,843 | 5/1935 | Kasley | 123/32 F |
| 2,488,361 | 11/1949 | Witzky et al. | 123/139 AP |
| 2,703,563 | 3/1955 | Hancock | 123/139 AP |
| 4,080,937 | 3/1978 | Wolters | 123/32 G |

FOREIGN PATENT DOCUMENTS 49-43650 11/1974 Japan .

*Primary Examiner*—Ira S. Lazarus
*Assistant Examiner*—Magdalen Moy
*Attorney, Agent, or Firm*—Kurt Kelman

[57] ABSTRACT

A fuel injection device for a Diesel engine provided in one combustion chamber thereof with a plurality of injection nozzles and as many plunger pumps; which device is adapted so that the time intervals at which the plurality of injection nozzles inject fuel into the combustion chamber are automatically optimized in accordance with the variable conditions under which the engine is put to operation, whereby the formation of nitrogen oxides in the exhaust gas of the engine is controlled without entailing any decline in the engine output.

3 Claims, 4 Drawing Figures

FUEL INJECTION DEVICE FOR COMPRESSION IGNITION ENGINE

BACKGROUND OF THE INVENTION

This invention relates to a fuel injection device for use in compression ignition engines such as the Diesel engine.

In recent years, the nitrogen oxides entrained by the exhaust gas from engines are causing such serious environmental pollution as to cause the adoption of legal countermeasures. For Diesel engines, there have been proposed many methods for controlling the formation of nitrogen oxides in the exhaust gas. One method comprises having one combustion chamber provided with a plurality of injection nozzles and allowing the fuel to be simultaneously injected from the plurality of injection nozzles into the combustion chamber. Another method comprises having one combustion chamber provided with a plurality of injection nozzles and one plunger pump and allowing the fuel to be injected into the combustion chamber in a multistage manner (Japanese Patent Laid-open Publication No. 119103/1975 and No. 119130/1975). Still another method comprises connecting one injection nozzle with or two injection nozzles respectively with two injection systems having different injection ratios and allowing the fuel to be fed from the injection systems to the injection nozzle(s) (Japanese Patent Laid-open Publication No. 28331/1972 and No. 83219/1973). Still another method comprises having one combustion chamber provided with a plurality of injection nozzles and as many plunger pumps and allowing the fuel to be injected into the combustion chamber at fixed time intervals on a staggered time schedule (Japanese Patent Publication No. 5513/1957 and No. 43650/1974).

In the engines designed for working the methods described above, the time intervals are invariably fixed without reference to the conditions under which the engine is put to operation. Accordingly, when the conditions have been varied, it has been difficult to obtain effective control of the formation of nitrogen oxides in the exhaust gas with these methods.

An object of this invention is to provide a fuel injection device for a compression ignition engine having one combustion chamber with a plurality of injection nozzles and as many plunger pumps, which device is adapted to cause the time intervals at which the plurality of injection nozzles inject fuel into the combustion chamber to automatically be optimized in accordance with the variable conditions under which the engine is put to operation to thereby ensure efficient combustion of fuel and effective control of the formation of nitrogen oxides in the exhaust gas.

In case where the timing of the injection of fuel into the combustion chamber is varied with the increase in the rotational speed of the engine, for example, the device according to the present invention can adjust the time intervals to be optimized so that effective control of the formation of nitrogen oxides and effective combustion can be obtained.

The term "time interval" used throughout the specification means the interval between the time the fuel is injected from one of the injection nozzles and the time it is injected from another injection nozzle.

SUMMARY OF THE INVENTION

To accomplish the object described above in accordance with the present invention, there is provided a fuel injection device for use with a compression ignition engine, which device comprises a plurality of cams each adapted to impart a definite motion to a relevant plunger pump, as many rotary shafts serving to retain the cams in working positions and arranged parallelly to one another, one of the aforementioned rotary shafts being adapted to convey the rotation of the crank shaft of the engine and the remaining rotary shafts being supported displaceably in the axial direction, helical gears secured one each on the rotary shafts and axially supported in such a manner that the helical gears on any adjoining rotary shafts will be held in mesh with each other, and injection interval adjusting means disposed one each on the aforementioned remaining rotary shafts and adapted to displace these rotary shafts in the axial direction relative to the rotary shaft serving to convey the rotation of the crank shaft in accordance with the velocity of the shaft rotation.

In the construction described above, the velocity of the rotation of the rotary shaft serving to receive the crank shaft increases with the increasing velocity of the engine rotation. The rotation of this rotary shaft is transmitted via the helical gears to the rotary shaft provided with an injection interval adjusting means. When a change occurs in the rotating speed of the rotary shaft, the injection interval adjusting means causes a corresponding displacement of the relevant rotary shaft in the axial direction. Since the two rotary shafts are meshed with each other through the medium of their helical gears, a phase shift occurs between these two gears. The rotary shafts are provided each with a cam adapted to impart a fixed motion to a relevant plunger. The rotary shaft which is displaced in the axial direction is rotated by a phase shift corresponding to the amount of displacement, with the result that the rotation of the shaft causes a corresponding change in the timing with which the cam acts upon the plunger. Thus, the time interval of fuel injection into the combustion chamber is varied with the velocity of the engine rotation.

When a centrifugal governor is used as the injection interval adjusting means, for example, it causes the rotary shaft to automatically move in the axial direction to thereby give rise to a phase shift between the movable rotary shaft and the rotary shaft serving to receive the crank shaft rotation. By adjusting the amount of movement of the rotary shaft and the helix angle of the helical gears in advance so that the time interval of fuel injection is optimized for the variable velocity of engine rotation, the fuel can be injected into the combustion chamber at the time interval best suited to the velocity of engine rotation to ensure both efficient operation of the engine and effective control of the formation of nitrogen oxides in the exhaust gas.

The other objects and characteristic features of the present invention will become apparent from the description to be given in detail hereinafter with reference to the accompanying drawing.

DESCRIPTION OF THE PREFERRED EMBODIMENT

In a compression ignition engine such as the Diesel engine, there is a close relation between the condition of combustion of the fuel inside the combustion chamber and the properties of the exhaust gas. This means that the properties of the exhaust gas can be controlled by proper control of the condition of the combustion of fuel. For effective control of the condition of combustion, due consideration should be given to several important factors such as shape of the combustion chamber, composition of the fuel, direction of the injection of fuel and injection characteristics of the fuel. The inventors continued a study with due consideration paid to the aforementioned factors and have, consequently, ascertained that in an engine having one combustion chamber with a plurality of injection nozzles, the characteristics of the exhaust gas can be effectively improved by adjusting the time intervals of fuel injection through the injection nozzles in accordance with the velocity of engine rotation as by allowing the crank angles at which the fuel is injected to be increased or decreased in direct proportion as the rotating speed of engine. This knowledge has led to the present invention.

To be specific, the inventors conducted an experiment on an air-cooled two-cycle 700-cc Diesel engine proper with the time interval between the pilot injection and the main injection varied so as to determine the relation between the maximum fraction burnt and the $NO_x$ concentration in the exhaust gas. The combustion chamber of this engine was a short, cylindrical swirl chamber and was provided with two injection nozzles disposed to permit injection of the fuel in different directions. The injection nozzles were each a single-hole nozzle 0.3 mm in diameter with the valve-opening pressure fixed at 180 kg/cm$^2$.

The experiment was carried out under the conditions of 450 rpm of engine rotation rate, about 140° C. of suction air temperature, about 400° C. of combustion chamber interior wall temperature, 60 of cetane number of the fuel, 21 mm$^3$/st of injection volume through the main injection nozzle, 7 mm$^3$/st of injection volume through the pilot injection nozzle and 1.9 of air excess ratio.

The experiment involved injecting the fuel to be burned in the combustion chamber for one cycle, thereby obtaining a diagram of the pressure curve for that particular combustion cycle and analyzing the change of pressure indicated in the diagram to determine the fraction of fuel burnt.

The analysis of the exhaust gas for nitrogen oxides (NO and $NO_2$) contents was accomplished by allowing the combustion of fuel to occur intermittently in every fourth cycle, transferring the resultant exhaust gas into an exhaust gas reservoir and assaying the exhaust gas with a nondispersion infrared-ray analyzer and a nondispersion ultraviolet-ray analyzer.

Figure 1:
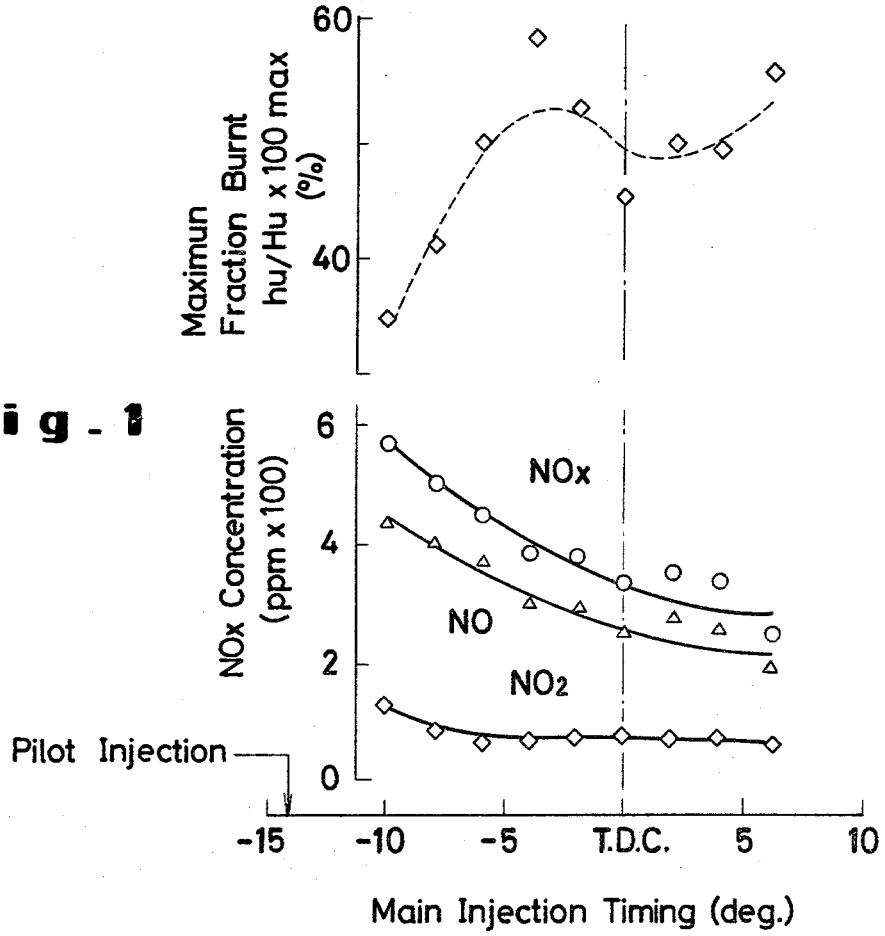
FIG. 1 is a graph showing the relation between the time interval of fuel injection, the maximum fraction burnt and the $NO_x$ concentration in the exhaust gas.

The injection of fuel was carried out with the timing of the pilot injection fixed at −14° relative to the top dead center (T.D.C.) and that of the main injection delayed by an increment of 2° between −10° and +6° to measure the respective volumes of exhaust gas and diagrams of pressure curves. Then the fractions of fuel burnt were determined by calculation using the data thus obtained. The results are graphically shown in FIG. 1. It is learnt from the graph that when the timing of the main injection effected subsequently to the pilot injection was between −4° of T.D.C. and 0° of T.D.C., the fractions of fuel burnt were largest and the volume of $NO_x$ ($NO+NO_2$) occurring in the exhaust gas was about 40% less than when the main injection was carried out at −10° of T.D.C.

The results of the experiment described above have lead the inventors to the conclusion that the control of the formation of nitrogen oxides in the exhaust gas can be effectively accomplished without impairing the operational efficiency of the engine by a method of allowing the time intervals of the pilot injection and the main injection to be increased proportionately to the increasing velocity of the engine rotation.

The fuel injection device designed on the basis of the conclusion described above for use with a compression ignition engine will be described with reference to the diagram of FIG. 2.

Figure 2:
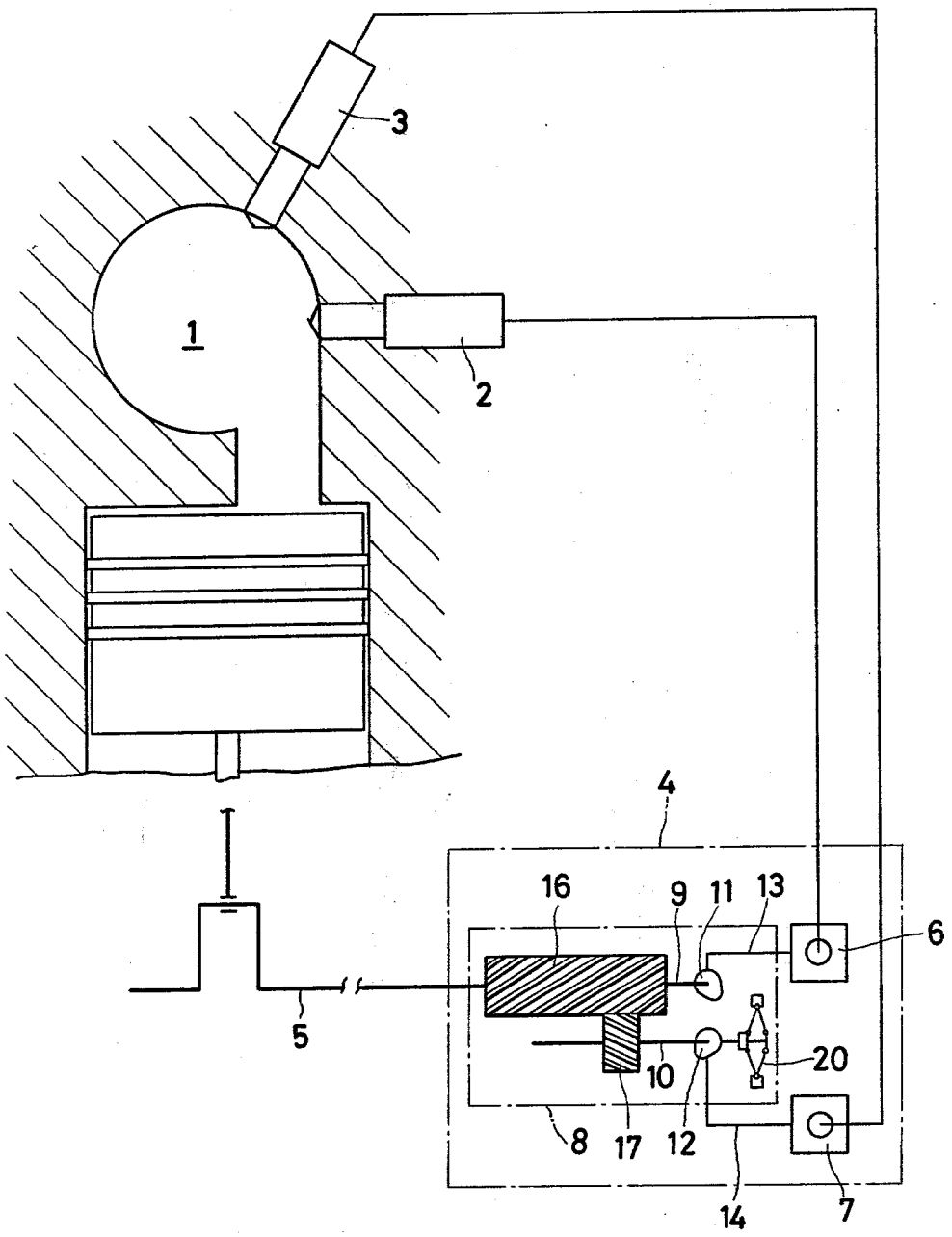
FIG. 2 is an explanatory view illustrating one embodiment of the fuel injection device of this invention for use with a Diesel engine.

FIG. 2 schematically illustrates a multi-injection type Diesel engine. A combustion chamber 1 is provided with a first injection nozzle 2 and a second injection nozzle 3. To the first injection nozzle 2 and the second injection nozzle 3, the fuel is fed from an injection pump 4. The injection pump 4 is operated by use of the rotation transmitted thereto through the medium of injection advance device (not shown) from a crank shaft 5 which is interlocked with a piston of the engine. The injection pump 4 is provided with two plunger pumps 6, 7 and injection interval adjusting device 8, with the plunger pump 6 connected to the first injection nozzle 2 and the plunger pump 7 to the second injection nozzle 3 respectively.

Figure 3:
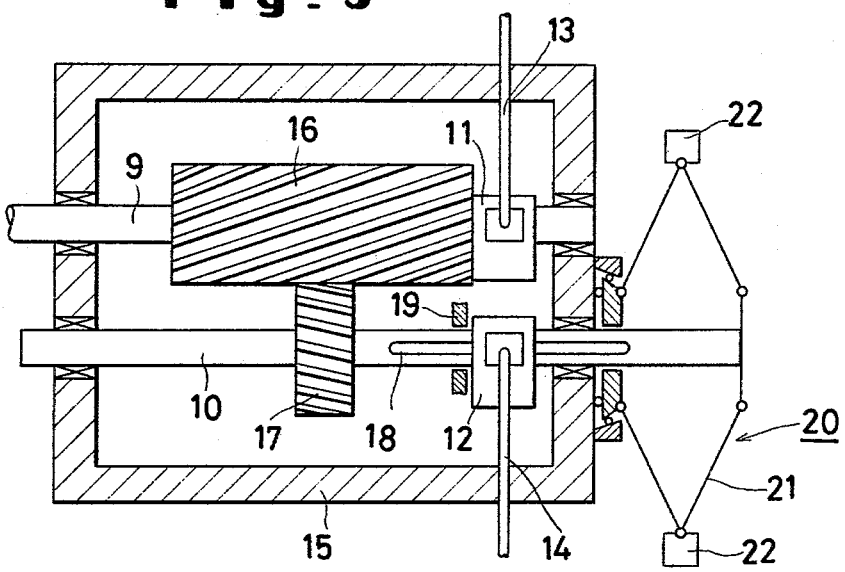
FIG. 3 is an explanatory view illustrating an injection interval adjusting means for the fuel injection device of FIG. 2.

As shown in FIG. 3 which illustrates the construction of the injection interval adjusting device 8, two rotary shafts 9, 10 are axially supported rotatably and parallel to each other inside a frame 15. The rotary shaft 9 is provided with a cam 11 and a helical gear 16 of a greater length. The rotary shaft 10 is axially supported slidably in the axial direction relative to the frame 15 and is provided with a cam 12 and a helical gear 17 which is meshed with the helical gear 16. This cam 12 is attached to the rotary shaft 10 in such a manner that it will be slidably moved in the axial direction by means of a key groove 18 formed linearly in the axial direction in the rotary shaft 10 and will be rotated integrally with the rotary shaft 10. When the rotary shaft 10 moves in the axial direction, therefore, the cam 12 tends to move similarly. A positioning member 19 which is fastened to the frame 15, however, prevents the cam 12 from producing an axial motion in conjunction with the rotary shaft 10. Thus, the cam 12 is allowed to produce a mere rotary motion in conjunction with the rotary shaft 10. The cam 11 actuates the plunger 13 of the plunger pump 6 and the cam 12 actuates the plunger 14 of the plunger pump 7.

On the portion of the rotary shaft 10 which protrudes from the frame 15, there is provided a centrifugal governor 20 which comprises a V-shaped link mechanism 21 and weights 22 placed at the tips of the link mechanism. One end of the link mechanism 21 is fastened to the leading end of the rotary shaft 10 and the other end thereof is rotatably supported by the frame 15. The radius of the rotation of the weights 22 increases with the increasing speed of the rotation of the rotary shaft 10. As a result, the width of the link mechanism 21 is reduced and the rotary shaft 10 is caused to move in the direction of the interior of the frame 15 (to the left in the diagram). The actuation of the injection interval adjusting means 8 is accomplished by the transmission of the rotation of the crank shaft 5 to the rotary shaft 9.

In the fuel injection device of the construction described above, the timing with which the first injection nozzle 2 injects the fuel into the combustion chamber 1 is fixed by the injection advance device (not shown). Any of the known injection advance devices can be used in unmodified form.

When the rotation of the crank shaft 5 is transmitted through the medium of the injection advance device to the rotary shaft 9 and the cam 11 is consequently rotated, the plunger 13 is pushed up to actuate the plunger pump 6 and forward the flow of the fuel to the first injection nozzle 2. As a result, the first injection of fuel is effected into the combustion chamber 1. At the same time, the rotation of the rotary shaft 9 is transmitted through the medium of the helical gears 16, 17 to the rotary shaft 10 to rotate the cam 12, push up the plunger 14, actuate the plunger pump 7 and, subsequently, cause the fuel to be injected through the second injection nozzle 3 into the combustion chamber 1.

The time interval between the first injection and the second injection is determined by the angle of the rotation which the cams 11, 12 are required to make in bringing the relevant plungers 13, 14 to their highest positions. If the angle of the rotation required for the cams 11, 12 to push up their relevant plungers 13, 14 is 12°, the second injection nozzle injects the fuel into the combustion chamber with an interval corresponding to 1/30 of one complete rotation of the crank shaft after the first injection nozzle makes an injection. In the conventional fuel injection device, the first injection and the second injection are always carried out at interval corresponding to 1/30 of the complete rotation of the crank shaft, no matter how much the speed of engine rotation may be varied.

In contrast, in the fuel injection device of the present invention, the speed of rotation of the rotary shaft 9 is increased and that of the rotary shaft 10 is consequently increased in proportion as the speed of rotation of the engine is increased. As a result, the centrifugal force of the weights 22 in the governor 20 provided on the rotary shaft 10 is increased and the radius of the rotation of the weights is proportionally increased, causing the rotary shaft 10 to be displaced to the left by a distance corresponding to the increase in the speed of rotation. The movement of the rotary shaft 10 consequently produces a displacement of the helical gear 17 in the axial direction. Since the helical gear 17 is meshed with the helical gear 16, the former gear 17 is compelled to move along the line of engagement between the threads of the two gears. Thus, the helical gear 17 will make a rotational displacement.

As described above, when there is an increase in the speed of engine rotation, the rotary shaft 10 produces a rotational displacement corresponding to the increase of the speed and, consequently, the timing with which the cam 12 disposed on the rotary shaft 10 pushes up the plunger 14 is proportionally changed. Accordingly, the times at which the first injection and the second injection are effected during each cycle of the engine motion are changed correspondingly.

When the speed of engine rotation is decreased, the rotation of the governor is proportionally lowered to decrease the centrifugal force of the weights and reduce the radius of rotation of the weights. Consequently, the rotary shaft 10 is moved to the right to produce a corresponding rotational displacement of the helical gear 17 and rotate the cam 12. As a result, the timing for the cam 12 to push up the plunger 14 is correspondingly changed. The time interval between the first injection and the second injection during each cycle of the engine rotation is changed.

The time interval between the first injection and the second injection during each cycle of the engine rotation is determined by the helix angle of the two helical gears and the construction of the governor. This time interval during each cycle of the engine rotation is desired to be so fixed that it will increase with the increasing speed of the engine rotation. By adjusting in advance the helix angle of the helical gears and the extent of displacement of the governor relative to the speed of rotation, therefore, the optimum injection time interval can automatically be obtained for the variable speed of the engine rotation.

FIGS. 2 and 3 illustrate an embodiment which provides effective control of the injection time interval by having one combustion chamber provided with one main injection nozzle and one pilot injection nozzle.

Figure 4:
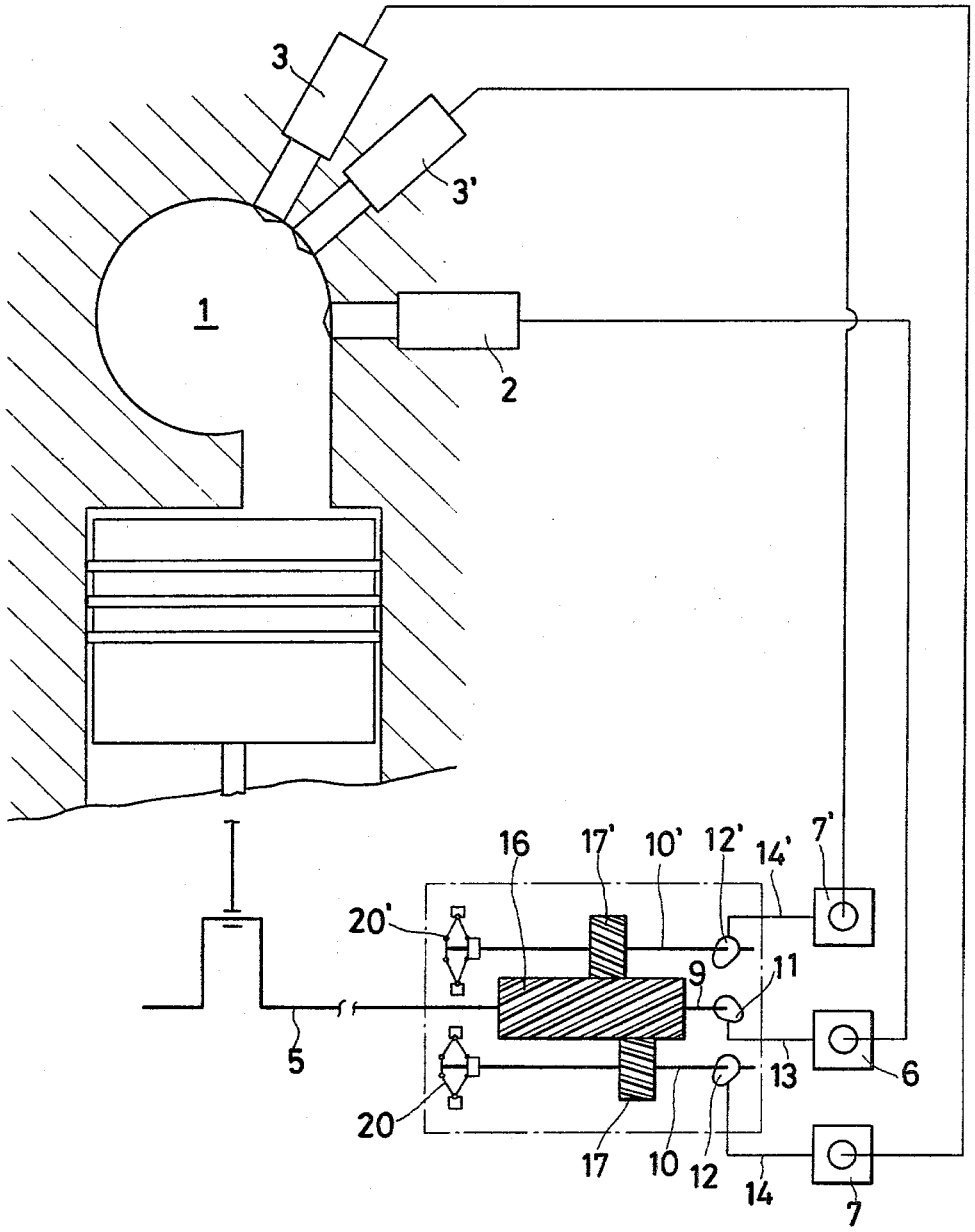
FIG. 4 is an explanatory view illustrating another embodiment of the fuel injection device of this invention for use with a Diesel engine.

In the case of another embodiment illustrated in FIG. 4 wherein the engine has one combustion chamber provided with two main injection nozzles and one pilot injection nozzle, the control of injection time intervals requires one rotary shaft 9 using a helical gear 16 of a greater length disposed at the center and two rotary shafts 10, 10' having helical gears 17, 17' of a smaller length disposed movably in the axial direction one each along the opposite sides of the rotary shaft 9, with the helical gears meshed effectively. The construction and operation of these rotary shafts 10, 10' are the same as those of the rotary shaft 10 involved in the preceding embodiment. They are provided with cams 12, 12' and governor mechanisms 20, 20' respectively.

When the rotation of the crank is transmitted to the rotary shaft 9, the fuel is injected into the combustion chamber first through the first injection nozzle 2. At the same time, the rotation of the rotary shaft 9 is transmitted to the two rotary shafts 10, 10' and, by the operations of the governor mechanisms 20, 20' to be produced proportionately to their respective speeds of rotation, the rotary shafts 10, 10' are displaced in the axial direction. Consequently, the times of the operations of the two cams 12, 12' during one cycle of the engine rotation are proportionally changed, causing the first injection, the second injection and third injection to be effected at the optimum time intervals. As the speed of the engine rotation is varied, the time intervals of injection are automatically varied by the effective cooperation of the governor mechanisms and the helical gears.

Engines come in various models. For each engine, the relation between the condition of fuel combustion and the characteristics of exhaust gas can easily be determined. For any person skilled in the art, it is easy to adjust the speed of engine rotation and the intervals of the first and second injections to their optimum conditions by proper combination of the governor mechanism and the helix angle of the helical gears. Thus, the present invention can easily be applied to all Diesel engines designed to perform first and second injections.

The embodiments of this invention have been described as relying upon the combination of the governor mechanism and the helical gears for the effective control of the time intervals of fuel injection proportionately to the speed of engine rotation. Alternatively, the effective control of the injection time intervals may be similarly accomplished by means of an electronic circuit, a hydraulic system, etc.

What is claimed is:

1. A fuel injection device for use with a compression ignition engine having a combustion chamber, a piston in the combustion chamber and a crank shaft rotated by the piston, the fuel injection device comprising the combination of (a) a plurality of injection nozzles leading into the combustion chamber, (b) a like plurality of plunger pumps arranged to feed fuel to the plurality of injection nozzles, (c) a like plurality of rotary shafts disposed parallel to each other, (1) one of the rotary shafts being arranged to be rotated by the rotating crank shaft of the engine and (2) the remaining rotary shafts being axially displaceably supported in relation to the one rotary shaft, (d) a cam mounted on each one of the rotary shafts, each cam being arranged to impart an operating motion to a respective one of the plunger pumps, (e) a helical gear secured to each one of the rotary shafts, the helical gears of adjacent ones of the rotary shafts meshing with each other, and (f) adjusting means arranged for axially displacing each one of the remaining rotary shafts relative to the one rotary shaft and thereby to change the meshed position of the helical gears of the remaining rotary shafts in direct proportion to the speed of rotation of the crank shaft of the engine.

2. The fuel injection device of claim 1, wherein the helical gear on the rotary shaft receiving the rotation of the crank shaft has a greater length than the length of the helical gears on said remaining rotary shafts.

3. The fuel injection device of claim 1, wherein the adjusting means is a centrifugal governor.

* * * * *